United States Patent [19]

Froman et al.

[11] 3,970,537

[45] July 20, 1976

[54] ELECTROLYTIC TREATING APPARATUS

[75] Inventors: Griff W. Froman, St. John; Albert Ray Mullins, Portage, both of Ind.

[73] Assignee: Inland Steel Company, Chicago, Ill.

[22] Filed: Apr. 14, 1975

[21] Appl. No.: 567,703

Related U.S. Application Data

[62] Division of Ser. No. 378,206, July 11, 1973, Pat. No. 3,901,771.

[52] U.S. Cl. ..... 204/211; 204/28; 204/206; 204/268; 204/DIG. 7; 204/224 R

[51] Int. Cl.[2] ..... C25D 5/02; C25D 7/06; C25D 17/12

[58] Field of Search ..... 204/28, 211, 300 EC, 204/205, 202, 203, 32, 49, 53 R, 224 R, 206, 268, DIG. 7

[56] References Cited

UNITED STATES PATENTS

| | | | |
|---|---|---|---|
| 2,044,415 | 6/1936 | Yates | 204/DIG. 7 |
| 2,673,836 | 3/1954 | Vonada | 204/28 |
| 2,676,146 | 4/1954 | Rendel | 204/211 X |
| 2,759,888 | 8/1956 | Rendel | 204/211 |
| 2,900,320 | 8/1959 | Metcalfe et al. | 204/300 |
| 3,420,760 | 1/1969 | Freedman et al. | 204/211 X |
| 3,510,410 | 5/1970 | Rosenthal et al. | 204/211 X |
| 3,573,175 | 3/1971 | Bedi | 204/DIG. 7 |
| 3,772,165 | 11/1973 | Yamagishi et al. | 204/28 |

*Primary Examiner*—John H. Mack
*Assistant Examiner*—A. C. Prescott
*Attorney, Agent, or Firm*—Hibben, Noyes & Bicknell, Ltd.

[57] ABSTRACT

An apparatus for electrolytically treating an endless steel strip comprising an electrolytic treating tank having guide means associated therewith which are adapted to guide a continuously moving endless strip into and out of the interior of the tank and having at least one electrode disposed within the tank directly facing only one of the wide surfaces of the endless strip while the strip is being guided through said tank by the guide means and at least one cathodic electrode spaced from the anodic electrode and disposed within said tank directly facing only the opposite wide surface of said endless strip. The anodic electrode is connected with the positive terminal of a first source of direct current, such as a plating rectifier, and the cathodic electrode is connected with the negative terminal of a second source of direct current, such as an etching rectifier, which is independent of the first source of direct current. Each of the source of direct current has the remaining electrical terminal thereof in electrical connection with the endless strip, and each source of direct current has means for independently regulating the magnitude of the direct current supplied to said terminals. The electrodes are disposed within the tank relative to the guide means so that neither of the wide surfaces of the endless strip is directly exposed to electric current from both the anodic and the cathodic electrodes while the endless strip is being electrolytically treated.

The apparatus can be used so as to provide one-side-only electroplating on the cathodic side of an endless metal strip and to control the amount of metal removed from the anodic surface of an endless metal strip.

5 Claims, 1 Drawing Figure

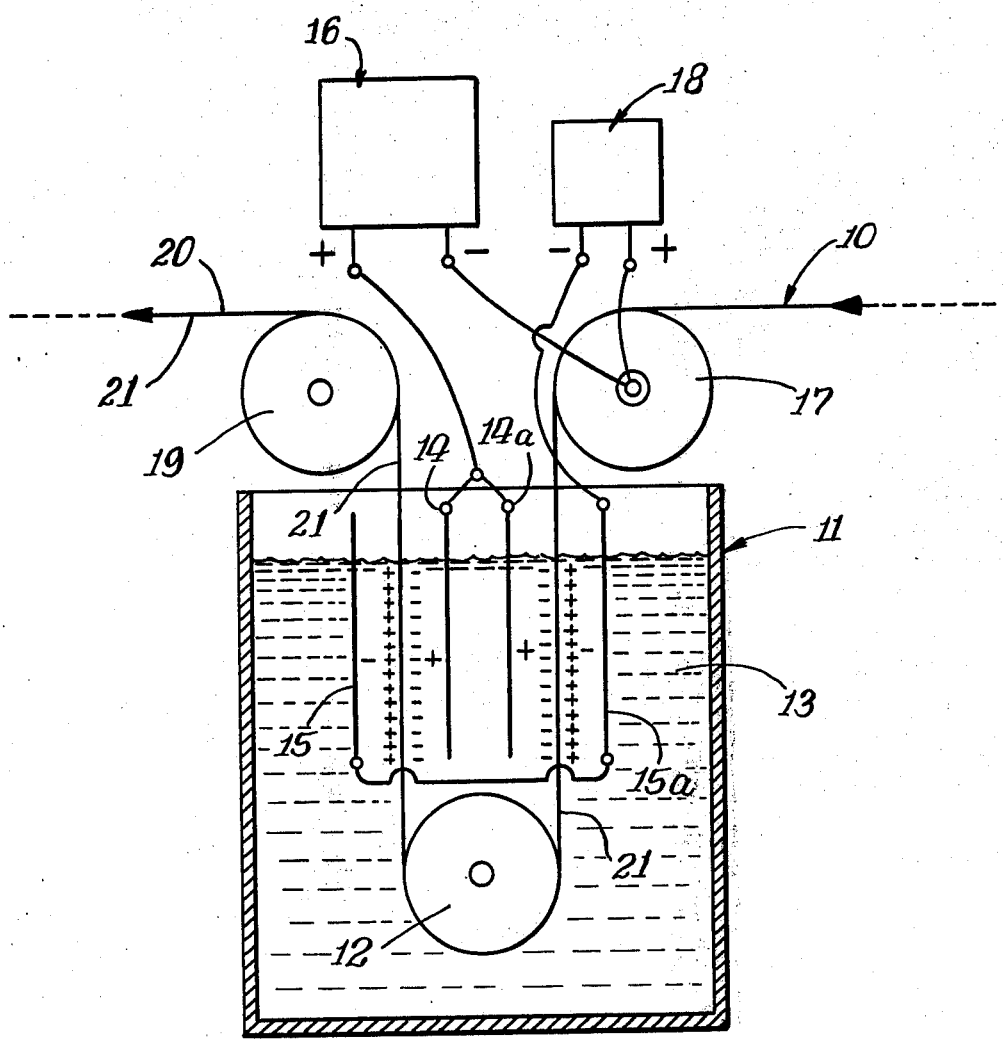
16
18
20
10
21
17
19
14
14a
21
11
13
15
15a
21
12

ELECTROLYTIC TREATING APPARATUS

The present application is a divisional application of U.S. patent application Ser. No. 378,206, filed July 11, 1973 of Griff W. Froman and Albert R. Mullins, now U.S. Pat. No. 3,901,771

It is frequently desirable to coat a metal strip, such as an endless steel strip, with a protective or decorative coating on one-side-only so that the opposite side of the strip remains free of the coating material. For example, where steel sheet material is to be used for making automobile bodies, it is desirable to provide one side of the sheet material with a coating of zinc to reduce corrosion, while the other surface of the material remains free of zinc so that the surface can be satisfactorily painted or lacquered.

When a steel strip is continuously electroplated in accordance with presently available one-side electroplating procedures, however, it is difficult to avoid depositing zinc on both sides of the steel strip, particularly along the longitudinal edges of the strip, and producing what is called the "wrap-around" effect. Many attempts have been made to overcome or minimize the "wrap-around" effect, such as using various types of current shields or barriers to limit the flow of electroplating current. Processes which rely on inducing a bi-polar charge on the strip, such as disclosed in Japanese Patent No. 8957 of 1963 issued to Hitachi, have objectionable features which preclude certain commercial applications thereof.

It is an object of the present invention to electrolytically deposit metal or an organic electropainting material on limited portions of the surface of an electrically conductive metallic strip without requiring the use of current shields or barrier coatings.

Other objects of the present invention will be apparent to those skilled in the art from the following detailed description and appended claims when read in conjunction with the accompanying drawing showing a schematic vertical sectional view of a continuous in-line electrolytic coating apparatus for continuously coating an electrically conductive strip in accordance with the present invention.

In achieving one of the objects of the present invention a metal sheet, such as a strip of cold rolled low carbon steel conventionally used for electrogalvanizing, after cleaning and treating in any conventional manner to prepare the strip for electroplating, is electroplated on one-side-only by immersing the metal strip in an aqueous electrolyte having disposed therein means for electrically connecting the strip and spaced anodic and cathodic electrodes disposed on opposite sides of the strip with two separate electrical power sources so as to provide a "plating circuit" which maintains the one surface of the strip to be electroplated cathodic and an "etching circuit" which maintains the opposite surface of the strip which is not to be plated anodic.

In order to provide the required "plating circuit" in which only the surface of the metal strip to be plated is made cathodic, the metal strip is electrically connected by any suitable means with the negative terminal of a plating rectifier providing a source of direct cathodic electroplating current, as in a conventional electroplating process, and the positive terminal of the plating rectifier is connected with an anodic electrode disposed adjacent but spaced from the surface which is to be electroplated. The "etching circuitk" which delimits the surface area electroplated by the plating circuit is established by connecting the positive terminal of an etching rectifier with the metal strip, and the negative terminal of the etching rectifier is connected to a cathodic electrode disposed in spaced relationship with the strip on the side of the strip opposite to that on which the anodic electrode is placed. Thus, the complete "plating circuit" in the present process comprises: (1) the plating rectifier negative terminal electrically connected with the metal strip, (2) the one lateral surface of the said metal strip which is electroplated, (3) the anodic electrode facing the lateral surface of the strip which is electroplated, (4) the positive terminal of the plating rectifier which is electrically connected with the anodic electrode, and (5) the plating electrolyte in which the strip and electrode are immersed. And, the complete "etching circuit" comprises: (1) the etching rectifier positive terminal which is connected with the metal strip, (2) the other lateral surface of the said metal strip which is opposite to the surface electroplated, (3) the cathodic electrode which faces the lateral surface of the strip which is not electroplated, (4) the etching rectifier negative terminal electrically connected with the cathodic electrode, and (5) the plating electrolyte in which the strip and electrode are immersed. Each of the foregoing plating and etching circuits can be varied independently, as will be described hereinafter, for controlling the amount of electroplating "wrap-around" and etching of the unplated surface of the strip.

In the process of the present invention the surface of the metal strip facing the anodic electrode is maintained negatively charged (i.e. cathodic) by the plating circuit and is readily electroplated, as a result of the positive metal ions in the electrolyte being attracted to the negatively charged (i.e. cathodic) surface of the strip. The opposite surface of the strip facing the cathodic electrode is maintained positively charged (i.e. anodic) by the etching circuit and repels the positively charged metallic ions in the electrolyte so that this surface remains free of plating metal, and is etched as a result of withdrawal of ferric metal ions from the surface of the metal strip during the electroplating process.

The electrolyte in the present process preferably has the same compositions as in a conventional cathodic electroplating process, and the electrolyte is allowed to circulate freely about the metal strip in the electroplating chamber without the necessity of providing two baths having different compositions contacting the opposite sides of the metal sheet. The concentration of the plating metal ions in the electrolyte can be most conveniently maintained at a desirable level by forming the anodic electrode of material having the same composition as the metal coating to be plated on the sheet. The cathodic electrode can be of any electrically conductive material which is non-reactive in the electrolyte bath and can be formed of carbon, lead, stainless steel or a like metal which is inert to the electrolyte.

As an illustration of a specific application of the present invention and using the apparatus illustrated in the drawing, a cold rolled low carbon thin endless steel strip 10 is one-side electrogalvanized continuously by passing the strip 10 continuously through an electroplating tank 11 and around a sink-roll 12 the surfaces of which are formed of electrical insulating material and with the tank 11 containing a conventional zinc plating electrolyte 13. Immersed in the electrolyte 13 are two spaced planar anodic (+) electrodes 14, 14*a* disposed facing one of the lateral surfaces of the strip, such as the upper surface 20 which is to be electroplated, and two planar cathodic (−) electrodes 15, 15*a* are disposed on the other side of the strip 10 directly opposite the anodic electrodes 14, 14*a*, respectively, facing the opposite or lower surface 21 which is not electroplated. Each of the electrodes is spaced sufficiently from strip 10 to allow free circulation of the electrolyte so as to maintain a uniform composition throughout the electrolyte 13, and preferably each electrode is spaced uniformly between about one and one-half to five inches from the surfaces of the steel strip 10.

The anodic electrodes 14, 14*a* are connected with the positive terminal of a source of direct current, such as the plating rectifier 16, while the negative terminal thereof is connected with roll 17 which forms an electrical contact with the strip 10. The cathodic electrodes 15, 15*a* are connected with the negative terminal of an etching rectifier 18 which provides an independent source of direct current which has the positive terminal thereof connected with the contact roll 17.

The anodic electrodes 14, 14*a* are preferably formed of the metal being plated, and the cathodic electrodes 15, 15*a* are formed of lead but can be formed of carbon, stainless steel or like electrically conductive material inert toward the electrolyte. All the electrodes are of the same width and have a width substantially equal to the width of the steel strip 10 being electroplated. The oppositely disposed surfaces of the electrodes have substantially equal areas, and the electrodes 14, 14*a* and 15, 15*a*, respectively, and the steel strip 10 are preferably parallel with the mid-points thereof in substantially the same vertical plane. The sink roll 12, the electrical contact roll 17, and guide roller 19 maintain the strip 10 midway between the electrodes 14, 14*a* and 15, 15*a* as the strip is passed through the tank 11.

An electrical current sufficient to provide a current density corresponding to that employed in a conventional cathodic continuous electroplating process which provides the desired coating weight is applied to the strip 10 by the plating rectifier 16 through the electrical contact roll 17. The current output of the etching rectifier 18 is adjusted to a level substantially lower than the ampere output of the plating rectifier 16 so that substantially less electric current is applied by the etching circuit to strip 10 than is applied to the strip 10 by the plating rectifier 16. Metal is electrodeposited on the negatively charged upper surface 20 which comprises one of the elements in the plating circuit. The lower surface 21 which comprises one of the elements of the etching circuit remains entirely free of zinc, because the surface 21 is positively charged, repelling the positively charged metal ions in the electrolyte, and is also etched as a result of having ferrous metal ions removed from the surface thereof by means of an etching or reverse electroplating current.

The ampere output of the etching rectifier 18 is varied to control the degree of "wrap-around" formed on the strip. For example, if in a particular electroplating process where no etching rectifier current is applied (i.e. the etching circuit is inactive) and the "wrap-around" on the surface 21 were relatively large, such as a strip ½ inch wide extending along the longitudinal edges of the metal strip 10, the "wrap-around" can by means of the present process be reduced to a very narrow unobjectionable band extending along the longitudinal edges or can be restricted precisely to the edge of the strip by applying sufficient electric current by means of the etching rectifier 18 so as to activate the etching circuit to the degree required to reduce or eliminate the "wrap-around".

It will be evident in the above described process that by varying the magnitude of the etching current relative to the plating current, but always maintaining the etching circuit amperage substantially below the amperage of the plating circuit, it is possible to control the amount of iron removed from that surface of the strip which is maintained anodic by the etching circuit in addition to controlling the extent of "wrap-around" on the strip. Thus, when the etching current is maintained, for example, at a level 1/10th the plating current, the amount of iron removed from the anodic surface of the strip will be substantially 1/10th the amount of metal plated on the cathodic surface of the strip. In this way, iron contamination of the plating bath is substantially reduced and controlled.

Tests were conducted on an experimental continuous electroplating line using apparatus having the above described structure and arrangement to simulate production continuous electroplating line operating conditions and using an endless strip of cold rolled low carbon steel about 9 inches wide, wherein the strip was subjected to alkaline cleaning, water rinsing, acid pickling, and water rinsing to prepare the strip for electroplating. In each of the tests the strip was electroplated in accordance with the present invention with the anode being formed of the metal being electroplated and the cathode being formed of lead.

EXAMPLE I - One-Side-Only Zinc Plating

| Electrolyte Composition | Oz/gal. | Temp. °F | Range of pH |
|---|---|---|---|
| Zinc sulfate ($ZnSO_4.7H_2O$) | 32–48 | 75–140 | 3.5–4.2 |
| Ammonium Chloride ($NH_4Cl$) | 2–4 | | |
| Aluminum Sulfate ($Al_2(SO_4)_3.18H_2O$) | 4 | | |

The endless low carbon steel strip was one-side electroplated using the above described apparatus by having the plating rectifier output adjusted to provide a current density of 30 amp/ft$^2$ (asf) with the etching circuit output being controlled to provide 10 asf. A coating of zinc 0.05 mils thick was deposited on only one side of the strip in a total of 1.43 minutes treating time.

In another test run with the foregoing bath and apparatus the plating circuit current was set to provide 300 asf and the rectifier circuit set to provide 30 asf with like results. A zinc coating 0.05 mils thick was electrodeposited on the strip on one side only in a total treating time of 0.145 minutes.

EXAMPLE II - One-Side-Only Nickel Plating

| Electrolyte Composition | Oz/gal. | Temp. °F | Range of pH |
|---|---|---|---|
| Nickel Sulfate ($NiSO_4.6H_2O$) | 40 | 90–160 | 2.0–5.2 |
| Nickel Chloride ($NiCl_2.6H_2O$) | 6 | | |
| Boric Acid | 4–5 | | |

The endless low carbon steel strip was plated in the above described electrolyte and continuous electroplating apparatus, wherein the plating rectifier circuit output was set to provide a current density on the surface to be plated of 60 asf with the etching circuit output set to provide 10 asf. A 0.05 mil thick coating of nickel was deposited on only one side of the strip in a total treating time of 1 minute.

EXAMPLE III - One-Side-Only Nickel Plating

| Electrolyte Composition | Oz/gal. | Temp. °F | Range of pH |
|---|---|---|---|
| Nickel Chloride ($NiCl_2.6H_2O$) | 32 | 100–145 | 0.9–1.1 |
| Boric Acid | 4 | | |

The endless low carbon steel strip was plated in the above described electrolyte and continuous electroplating apparatus wherein the plating rectifier output was set to provide a current density of about 500 asf while the etching rectifier output was set to provide about 50 asf. A 0.05 mil thick coating of nickel was plated on only one side of the strip in a total treating time of 0.12 minutes.

In the process of the present invention, the output of the plating rectifier in the preferred embodiments is set at a conventional current output level to provide a current density on the surface to be plated which will effect electrodisposition of the desired coating weight of the metal during the period the strip is immersed in the electrolyte, and the etching circuit is then adjusted to a substantially lower level, preferably at between about 10% to 30% of the output of the plating rectifier, as required in order to effect the desired control of "wrap-around" and etching. The voltage used will vary depending on the current density, the efficiency of the bath, and the spacing, size and configuration of the electrodes. The line speed and the electrolyte temperature can be varied depending on the coating thickness and finish desired. However, in certain embodiments of the present invention the voltage is preferably controlled, as is the case when electropainting an organic coating material on a ferrous metal surface using the present process.

The foregoing test data are typical of the results obtained when electroplating a steel strip on one-side-only in accordance with the present invention and show that highly satisfactory one-side-only metal electroplating results without "wrap-around" can be produced on a continuous electroplating line using the etching circuit with the electrolyte composition and the cathodic plating circuit in accordance with the operating conditions of a conventional cathodic continuous electroplating line employing only the minor additions and modifications described herein.

Other protective metal coatings and decorative coating materials can be applied to a limited portion of the surface of an electrically conductive article by the process of the present invention in addition to those set forth in the specific examples. Thus, any other metal which is capable of being electroplated from an aqueous bath can be used, including such metals as tin, cadmium, copper, lead, chromium, the noble metals, the rate earth metals, and alloys of any of the foregoing metals. A satisfactory electrolyte composition for electroplating any of the foregoing metals or others can be obtained by referring to a standard electroplating handbook, such as *Electroplating And Related Processes* by J. B. Mohler; publisher: Chemical Publishing Co., NYC, NY; 1969 Ed. It should be also understood that the surface on which the coating metal is electroplated does not have to be a ferrous metal surface, but can be any other metallic surface. Thus, a ferrous metal sheet or strip can be provided with a coating of a non-ferrous metal before one-side electroplating in accordance with the present invention. For example, a ferrous metal strip in one embodiment of the present invention can first be coated on one-side-only or on both sides by any procedure with copper and then the strip can be coated on one-side-only with nickel by the process of the present invention. It will also be understood that any electrically conductive material in addition to a ferrous metal strip, and including chromium plate, aluminum and the like metals, can be one-side coated by the present process whether formed of one electrically conductive metal or of a plurality of layers of electrically conductive metals. Any of the conventional procedures for preparing the surface of the metal for electroplating can be used.

While the specific examples illustrating the present invention show electrolytically coating a strip with a metal, the present invention can also be used to electrodeposit on only one-side of a metal strip an organic electropaint material, such as a water soluble acrylic or epoxy resin, from a conventional electropainting bath composition.

We claim:

1. In an apparatus for continuously electrolytically treating an endless wide strip of an electrically conductive material including an electrolytic tank adapted to hold an electrolyte bath and having associated therewith guide means for guiding the said strip continuously into and out of the interior of the tank between spaced anodic and cathodic electrodes, the improvement comprising;

a. all said anodic electrodes being disposed within said tank directly facing only one wide surface of said endless strip, b. all said cathodic electrodes being disposed within said tank directly facing only the opposite wide surface of said endless strip, c. each said anodic electrode being connected with the positive terminal of a first source of direct current, d. each said cathodic electrode being connected with the negative terminal of a second source of direct current which is independent of said first source of direct current, e. each said source of direct current having the respective negative and positive electrical terminals thereof electrically connected with said endless strip, and f. each said source of direct current having means for independently regulating the magnitude of the direct currents supplied to said electrodes and strip.

2. An apparatus as in claim 1, wherein each remaining electrical terminal of each said source of direct current is in electrical connection with said guide means, and said guide means is in electrical connection with said endless strip.

3. An apparatus as in claim 2, wherein said guide means comprise an electrical contact roll at the inlet side of said tank.

4. An apparatus as in claim 1, wherein each said electrode is disposed in a plane parallel to the plane of said endless strip while said strip is being electrolytically treated in said tank, and said guide means is adapted to maintain said endless strip midway between said electrodes while said strip is being electrolytically treated within said tank.

5. An apparatus as in claim 4, wherein said electrodes have substantially the same width as said endless strip.

* * * * *